United States Patent [19]

Forsythe et al.

[11] Patent Number: 4,856,969

[45] Date of Patent: Aug. 15, 1989

[54] FLUID POWERED DIAPHRAGM PUMP WITH CYCLE TIMER

[75] Inventors: Carl Forsythe; John L. Dorminy, both of Sand Springs; Joseph W. Raymon, Skiatook, all of Okla.

[73] Assignee: The Gorman-Rupp Company, Mansfield, Ohio

[21] Appl. No.: 211,972

[22] Filed: Jun. 27, 1988

Related U.S. Application Data

[63] Continuation-in-part of Ser. No. 34,013, Apr. 1, 1987, abandoned.

[51] Int. Cl.[4] ..... F04B 43/06

[52] U.S. Cl. ..... 417/395; 417/9

[58] Field of Search ..... 417/395

[56] References Cited

U.S. PATENT DOCUMENTS

| | | | |
|---|---|---|---|
| 2,239,270 | 4/1941 | Jahreis | 417/9 |
| 3,176,623 | 4/1965 | Howerton et al. | 417/9 |
| 3,781,141 | 12/1973 | Schall | 417/395 |
| 3,814,548 | 6/1974 | Rupp | 417/395 |
| 4,621,990 | 11/1986 | Forsythe et al. | 417/395 |

*Primary Examiner*—Carlton R. Croyle
*Assistant Examiner*—D. Scheuermann
*Attorney, Agent, or Firm*—Watts, Hoffman, Fisher & Heinke

[57] ABSTRACT

A hydraulically activated diaphragm pump. A pressure source is coupled to a pump diaphragm during a pump discharge stroke. During this discharge stroke, an air activated return assist cylinder is vented to atmosphere. On the return stroke the pump housing above the diaphragm is vented and the air cylinder activated. A single 4-way solenoid actuated valve controlled by an adjustable timer accomplishes this cylic pumping action. The timer is adjustable to set the number of pump cycles per minute and also adjusts the discharge stroke period of each cycle. A pressure regulator adjusts the pressure of air routed through the solenoid actuated valve to provide relatively high pressure air to the diaphragm on the discharge and low pressure air to the air cylinder on the return stroke.

8 Claims, 4 Drawing Sheets

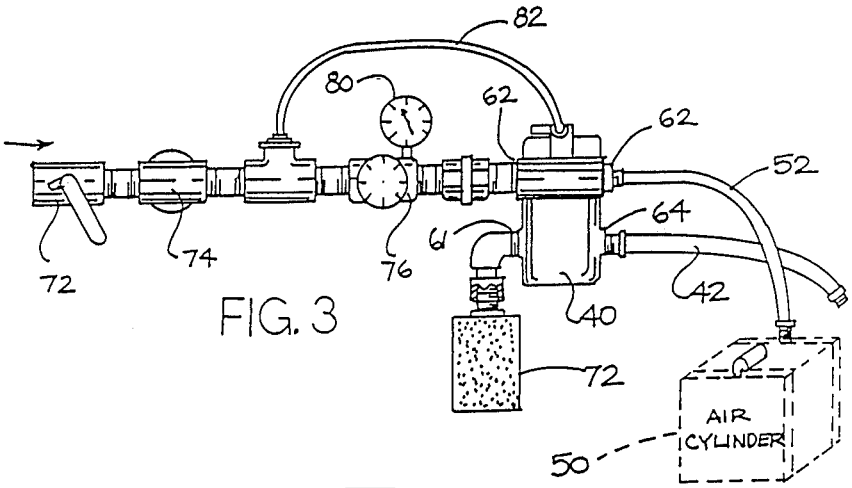
FIG. 3
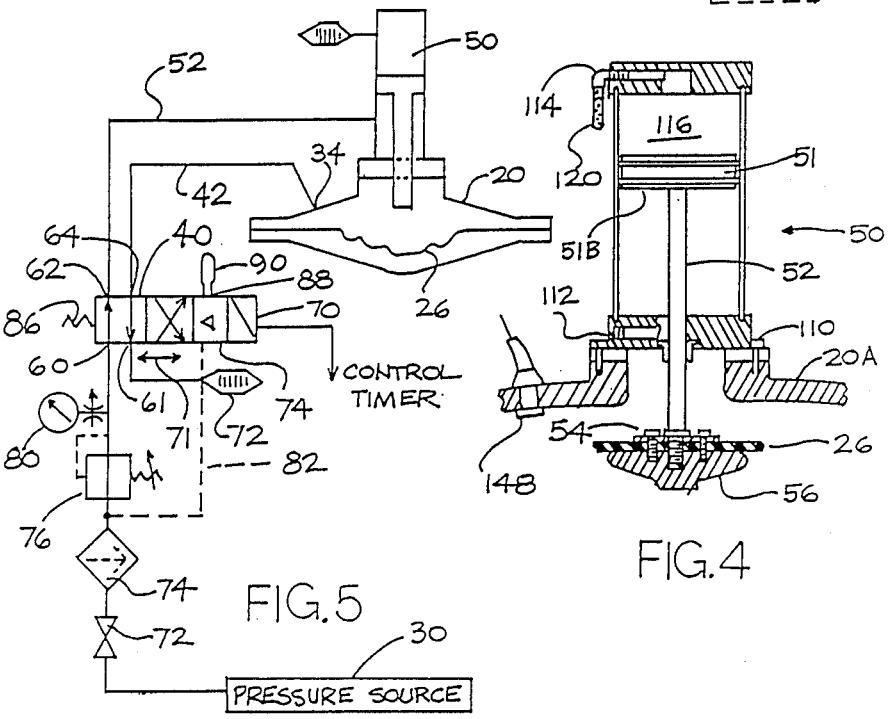
FIG. 4
FIG. 5

52'
112'
50'
10'
42'
26'
34'
20'
24'
22'
16'
CONTROL
40'
86'
70'
80'
EXHAUST
150
154
CONTROLLER
152
180
174
PILOT
176
156
162a
DISCHARGE
172
SUCTION
170
164a
FILTER
74'
160
162
164
SHUT-OFF VALVE
72'
AIR INLET (100 PSI)

FLUID POWERED DIAPHRAGM PUMP WITH CYCLE TIMER

CROSS REFERENCE TO RELATED APPLICATIONS

The present application is a continuation-in-part of application Ser. No. 34,013 entitled "Hydraulic Diaphragm Pump Method and Apparatus" to Forseyth et al., filed Apr. 1, 1987, abandoned July 6, 1988.

TECHNICAL FIELD

The present invention relates to a diaphragm pump wherein both a pump discharge stroke and a suction return stroke are hydraulically activated.

BACKGROUND ART

A diaphragm pump operates by controlled application of a fluid pressure against a diaphragm mounted within a pump housing. During a pump discharge stroke, the diaphragm exerts pressure upon fluid within the housing causing that fluid to be pumped from a housing outlet. On a suction or return stroke, the diaphragm is withdrawn to allow fluid to enter a housing inlet before a subsequent discharge stroke.

One prior art pump design known to applicants includes a housing inlet for routing compressed fluid against the diaphragm during the pump discharge stroke. On the return stroke, the region above the diaphragm is vented to atmosphere, and the return stroke is assisted with a mechanical return device coupled to the diaphragm. One application of this diaphragm pump is in a sewage treatment plant where fluid and suspended solids are routed to treatment stations in the plant.

Examples of two prior art pump designs having mechanical return assists are disclosed in U.S. Pat. Nos. 3,816,034 to Rosenquest and 4,621,990 to Forsythe et al. During the diaphragm pump discharge stroke energy is stored in an assist spring coupled to the pump diaphragm by a rod. The arrangement disclosed in the '990 patent to Forsythe et al utilizes an extension spring for the storage of this energy. After each discharge stroke, the pump housing is vented to atmosphere, and the extension spring exerts a restoring force on the diaphragm in preparation for the next discharge stroke.

The Forsythe et al cycle period is controlled by a timer which opens and closes a solenoid activated valve to couple pressurized air to the top of the diaphragm during the discharge stroke. The timing cycle of the timer is adjusted to maximize pumping capacity of the pump. Too short a time interval for the pumping cycle causes the diaphragm to only partially complete its discharge stroke. Since the return assist is a mechanical arrangement, this return automatically imparts a return force on the diaphragm whenever the solenoid activated valve is closed by the timer.

One disadvantage with spring assist diaphragm pumps is the fact that while the air pressure drives the diaphragm through the pump housing the air is working against the restoring force of the spring assist. This necessitates the use of high air pressures to drive the pump diaphragm and reduces the pump's puming capacity.

U.S. Pat. No. 3,781,141 to Schall discloses a diaphragm pump having a hydraulic return assist. The energy for supplying the assist in this patent is provided by an external fluid supply coupled to a piston for moving the pump diaphragm on the return stroke.

The timing of discharge and return strokes in the '141 patent to Schall is based upon pump performance. Limit switches mounted to the pump housing controllably activate a valving system disclosed in the aforementioned '141 patent to Schall. Pressure is supplied to the diaphragm until this pressure has moved the diaphragm and attached piston an amount to activate a limit switch. A second limit switch senses return movement of the piston and causes the valving system to switch to a discharge stroke.

Applicants know of no commercialization of the diaphragm pump disclosed in the '141 patent to Schall. The use of limit switches to control the cycle time of such a pump, however, would appear to be disadvantageous since the pump operation can only be controlled indirectly by adjusting the pressure applied to the diaphragm. Also, the complex valving system disclosed in the Schall patent increases the cost of such a pump and decreases its reliability.

DISCLOSURE OF THE INVENTION

The present invention relates to a fully hydraulic diaphragm pump wherein power for both the discharge and return stroke is from a common pressure source. During the discharge stroke, pressurized fluid is routed to a top surface of the diaphragm while a fluid actuated return cylinder is vented to atmosphere. During the return stroke the fluid actuated cylinder is pressurized while the diaphragm pump housing is vented to atmosphere. Control over the pump cycle time is through a single 4-way solenoid actuated valve operated by a pump timer set to achieve a desired pump performance.

A diaphragm pump constructed in accordance with the invention includes a pump housing having an interior pumping chamber. An inlet leading to the chamber delivers effluent to the chamber and an outlet discharges the effluent from the chamber. A flexible diaphragm is supported within the chamber to apply pumping pressure to the effluent in a cylic pumping action including a discharge stroke wherein effluent is pumped from the chamber and a return stroke where effluent is allowed to enter the pumping chamber.

The invention further includes a pressure source for directing fluid under pressure, typically compressed air, against the flexible diaphragm to exert a pumping action during the discharge stroke. A return device includes a pressure cylinder mounted to the diaphragm pump chamber and including a piston which is coupled to the flexible diaphragm. The cylinder is actuated during the return stroke and returns the diaphragm to a position for the beginning of a next subsequent discharge stroke. A valve coupled to the pressure source controllably routes pressurized air to the diaphragm chamber during the discharge stroke and to the air actuated pressure cylinder during the return stroke. When the diaphragm is pressurized during the discharge stroke, the air cylinder is vented to atmosphere, and when the air cylinder is actuated during the return stroke, the pump housing is vented to atmosphere.

A timer controls the actuation of the valve and has two adjustments for controlling the pumping cycle. A first adjustment determines the time interval the pump housing is pressurized on the discharge stroke. A second adjustment determines the cycle time or frequency of cycles per minute. In combination, these two adjustments allow the pumping action to be monitored and adjusted to maximize pump performance.

Experience with the invention indicates lower pressures can be utilized with the diaphragm pump of the invention. This is attributable to the fact that the fluid pressure applied to the pump diaphragm does not have to overcome the restoring action of a return assist spring. Since the air cylinder used in the preferred embodiment of the invention is vented to atmosphere, the work done by the pressurized air is against the diaphragm and fluid effluent inside the pump housing and not used to store energy in a return assist spring.

In accordance with a first embodiment of the invention a single solenoid actuated four-way valve interposed between the pressure source and the diaphragm pump delivers fluid pressure against the diaphragm and the air cylinder piston. The pressure of fluid directed to the piston during the return stroke is the same as the pressure of the fluid directed to the diaphgram on the discharge stroke. This is a less costly embodiment of the pump control and also makes the pump control simpler and therefore more reliable. The air cylinder is also smaller than the prior art mechanical assists and therefore results in a more compact pump housing.

In accordance with a second embodiment of the invention, a different pressure can be applied to the piston on the suction or return stroke than to the diaphragm on the discharge stroke. The suction pressure applied to the return assist cylinder can be substantially less, for example, than the pressure applied to the diaphragm during the discharge portion of the pumping cycle. In some applications on the return stroke the pressure need only lift the pump diaphragm and not pump effluent within the pump housing.

Separate adjustment of air pressure to the pump allows the pump to operate in an unbalanced mode. This allows adjustment of the pumping velocity to minimize water hammer in the lines coupled to the pump. Such adjustment also results in reduced air consumption since the air pressures can be adjusted to levels needed to move the effluent and no higher. Finally separate control over the two pressures allows the pump to move liquids that are shear sensitive.

From the above it is appreciated that one object of the invention is a new and improved diaphragm pump, hydraulically actuated on both a discharge and return stroke. This and other objects, advantages and features of the invention will become better understood from the following detailed description of a preferred embodiment which is described in conjunction with the accompanying drawings.

BRIEF DESCRIPTION OF THE DRAWINGS

FIG. 3 schematically illustrates a conduit system for routing pressurized air to a pump housing and return assist air cylinder;

FIG. 4 is a section view of a diaphragm pump return assist cylinder;

FIG. 5 is a hydraulic schematic of a diaphragm pump constructed in accordance with a first embodiment of the invention;

BEST MODE FOR CARRYING OUT THE INVENTION

Figure 1:
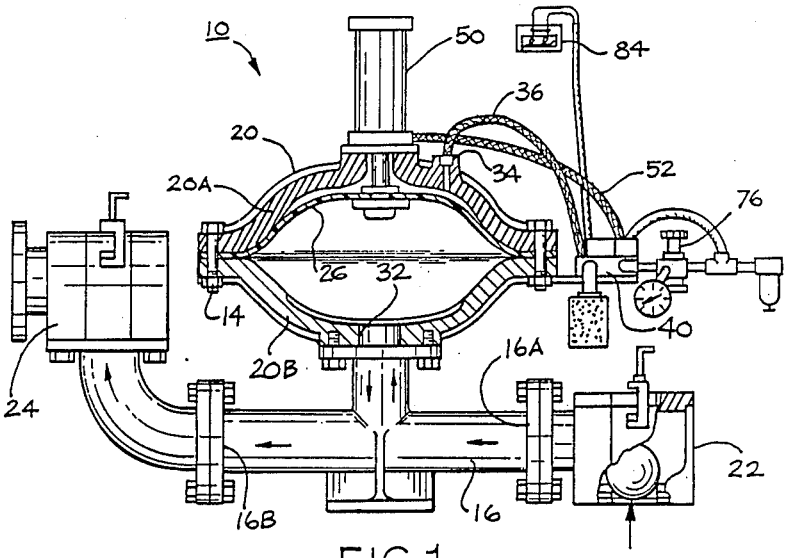
FIG. 1 is a schematic elevation view of a diaphragm pump constructed in accordance with the invention.
Figure 2:
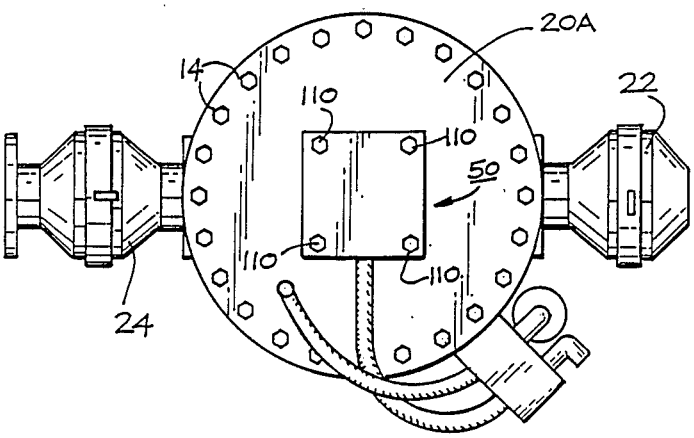
FIG. 2 is a top plan view of the FIG. 1 diaphragm pump.

Turning now to the drawings, a diaphragm pump 10 constructed in accordance with the invention includes a pump housing 20 having upper and lower housing portions 20*a*, 20*b* coupled together by threaded connectors 14. The housing 20 is supported on a T-conduit 16 having an inlet 16*a* and an outlet 16*b*. Check valves 22, 24 regulate effluent flowing into and out of the pump. More particularly, a first check valve 22 opens to allow fluid entering the check valve 22 to reach the T-conduit 16. During the discharge stroke of the pump, however, the check valve 22 closes, preventing effluent exiting the pump housing 20 from passing through the checkvalve 22. At the outlet side of the pump, the check valve 24 opens to allow effluent exiting the pump housing 20 to pass through the check valve 24 during the pump discharge stroke.

Additional details regarding the operation of a diaphragm pump are disclosed in U.S. Pat. No 4,621,990 to Forsythe et al. The disclosure of this prior art '990 patent is incorporated herein by reference.

A flexible diaphragm 26, mounted within the pump housing 20, is driven through the housing 20 on a discharge stroke to force effluent entering the housing through an opening 32 back through the opening 32 to the tee 16. On a return stroke the diaphragm 26 is retracted to allow effluent passing through the valve 22 to enter the housing 20. As illustrated in FIG. 1, the diaphragm 26 is at a top most position within the pump housing 20. An interior of the housing 20 is almost completely filled with effluent that has entered the housing 20 through the checkvalve 22.

The top portion of the housing 20 defines an opening 34 for pressurizing the region above the diaphragm 26 during the pump discharge stroke. Fluid (typically air) entering the housing forces the diaphragm through the housing to discharge fluid and suspended solids from the housing 20. A source 30 of compressed air (FIG. 5) routes compressed air to the inlet 34 through a four-way reversing valve 40 and air hose 42.

On a return stroke the diaphragm 26 is retracted to the position shown in FIG. 1. This is accomplished by an air cylinder 50 that is hydraulically actuated by the same pressure source 30 used in driving the diaphragm 26 through the pump housing on the discharge stroke. The air cylinder 50 includes a piston 51 coupled to a piston rod 52 attached to the diaphragm 26 by two diaphragm retention plates 54, 56. On the pump return stroke, the pump housing 20 is vented to atmosphere and the return assist cylinder 50 simultaneously pressurized by air routed to the cylinder through a second air hose 52. This retracts the diaphragm 26 to the position shown in FIG. 1.

After the diaphragm 26 has been retracted, a timer 84 coupled to a solenoid in the valve 40 begins a next discharge cycle by venting the air cylinder 50 and again supplying pressurized air to the top of the diaphragm 26.

FIGS. 3 and 5 depict the hydraulic system for activating the air cylinder 50 and pressurizing the pump housing 20. The four-way valve 40 includes an inlet 60 for receipt of pressurized fluid, typically air and an exhaust port 61. Depending upon the positioning of a spool within the valve 40, fluid entering the inlet 60 is coupled to one of two valve ports 62, 64. In the configuration schematically depicted in FIG. 5, a pilot valve operated by a solenoid 70 causes the valve spool to pressurize the air cylinder 50 while venting the pump housing 20 to atmosphere via the exhaust port 61. This is the situation when the solenoid 70 is de-energized. When the solenoid 70 is energized, the solenoid and the pilot valve cause the spool to move to pressurize the housing 20 and vent the cylinder 50. Movement of the valve spool within the valve body is schematically depicted by an arrow 71 in FIG. 5.

The conduit path from the pressure source 30 to the valve 40 includes an ON/OFF valve 72, air filter 74, and pressure regulator 76. A pressure gauge 80 allows a user to monitor the regulated pressure leaving the regulator 66 and facilitates adjustment of air pressure routed to the pump housing 20 and air cylinder 50.

At the beginning of the return stroke, as the air cylinder 50 is actuated by air pressure, the pump housing opening 34 above the diaphragm is vented to atmosphere through the air hose 42, valve 40 and a valve muffler 72 coupled to the exhaust port 61.

The valve 40 is a four-way reversing valve manufactured by MAC under Model No. 1351G-111D-1. A conduit 82 coupled to the pressure source 30 bypasses the regulator 66 and is coupled to a valve pilot accumulator 74. The solenoid 70 is controlled by the timer 84. A spring 86 integral with the valve 40 biases the valve spool to the position shown in FIG. 5 when the solenoid 70 is de-energized. A pilot exhaust 88 is muffled by a muffler 90. Additional details regarding the valve 40 are available in MAC bulletin #300G available from MAC Valves, Inc., P.O. Box 111, 30569 Beck Road., Wixom, Mich. 48096. This bulletin is incorporated herein by reference.

The air cylinder 50 comprises a 6 inch diameter model R-5 Hydroline air actuated cylinder bolted to the top of the housing 20 with threaded connectors 110. These connectors 110 allow the cylinder to be easily removed after the pump is depressurized by closing the on/off valve 72.

The air cylinder 50 (FIG. 4) defines an air inlet port 112 having a threaded inlet to accommodate the air hose 52. Application of pressurized air at this input port 112 applies pressure to a bottom surface **51*b* of the piston 51. An exhaust port 114 is in fluid communication with a region 116 above the piston 51 so that as air pressure raises the piston 51, the air above the piston is exhausted from the cylinder 50. A filter 120 connected to the exhaust port 114 prevents dust or dirt, etc. from entering the air cylinder when the port 112** is vented to atmosphere and the pump begins its discharge stroke.

An interior surface of the cylinder 50 is chrome plated to resist corrosion and scoring. Piston seals (not shown) are of a low friction design designed to enhance cylinder efficiency. The piston rod and piston assembly are permanently lubricated with a molybdenum disulfide grease to enhance cylinder life.

Figure 6:
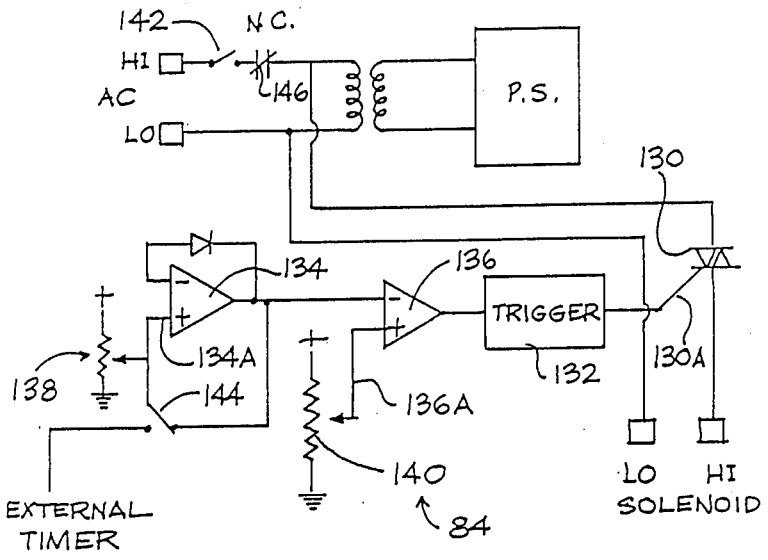
FIG. 6 is an electrical schematic of a preferred timer for controlling pumping frequency and discharge time of the diaphragm pump.

The timer 84 provides 115 volt 60 cycle per second energization signals to the valve solenoid 70 to initiate a pump discharge. The timer 84 is continuously adjustable to initiate the discharge stroke at a frequency of from 0 to 40 cycles per minute. A pump discharge time period can be set from 0 to 3 seconds. A preferred timer is commercially available from the assignee of the invention as Model No. W04 solid state timer and is schematically depicted in FIG. 6.

The timer 84 has an a.c. input which is selectively coupled to the solenoid 70 by a triac 130 having a control input **130*a* coupled to a triggering circuit 132. The triggering circuit 132 responds to signals from two timers 134, 136 having control inputs 134*a*, 136*a* connected to variable potentiometers 138, 140. A first timer 134 controls the pump cycle frequency and the second timer 136** controls the discharge time within each pump cycle.

Upon closure of an on/off switch 142 the timers 134, 136 generate timing signals at controlled frequencies dictated by the setting of the two potentiometers 138, 140. If a manual switch 144 is switched from an A to B contact the cycle frequency is controlled from an external timing source and only the discharge time adjusted by the timer 136.

All timing signals are disrupted if a normally closed relay contact 146 opens. The contact 146 is controlled by a relay coupled to a moisture sensor 148 (FIG. 4) inside the pump housing 20. If the diaphragm 26 fails, the sensor 148 will signal the relay and open the contact 146. A preferred sensor 148 is a model 16 VM sensor available from Warrich Controls Inc., 1964 West Eleven Mile Road, Berkley, MI, 48072 and is described in bulletin 262.

To adjust pump capacity, it is recommended that the cycle rate be set to 20 cycles per minute and the discharge time to 0.5 seconds. When the system is activated, the pump operation is observed. If the diaphragm does not appear to be making a full stroke, (the user can monitor diaphragm movement through a glass window in the upper pump housing), the discharge time is increased in quarter second increments until a complete stroke is attained. The pump cycle can then be adjusted in combination with the air pressure regulator 76 routing compressed air to the pump housing. When these dependent variables are modified to maximize pump performance the discharge time is again modified (if needed).

Preliminary experience with the FIG. 5 embodiment of the diaphragm pump has been excellent. The maximum rated pump capacity for a pump having a 4 inch diameter inlet and a pumping capacity per stroke of 4.5 gallons is 180 gallons per minute or 40 cycles per minute. A maximum pump pressure or head of 210 ft. can be achieved with input air pressure of no more than 100 psig. The short cylinder length results in a total pump height from the base of the Tee 16 to the top of the air cylinder 50 of 40 inches.

Figure 7:
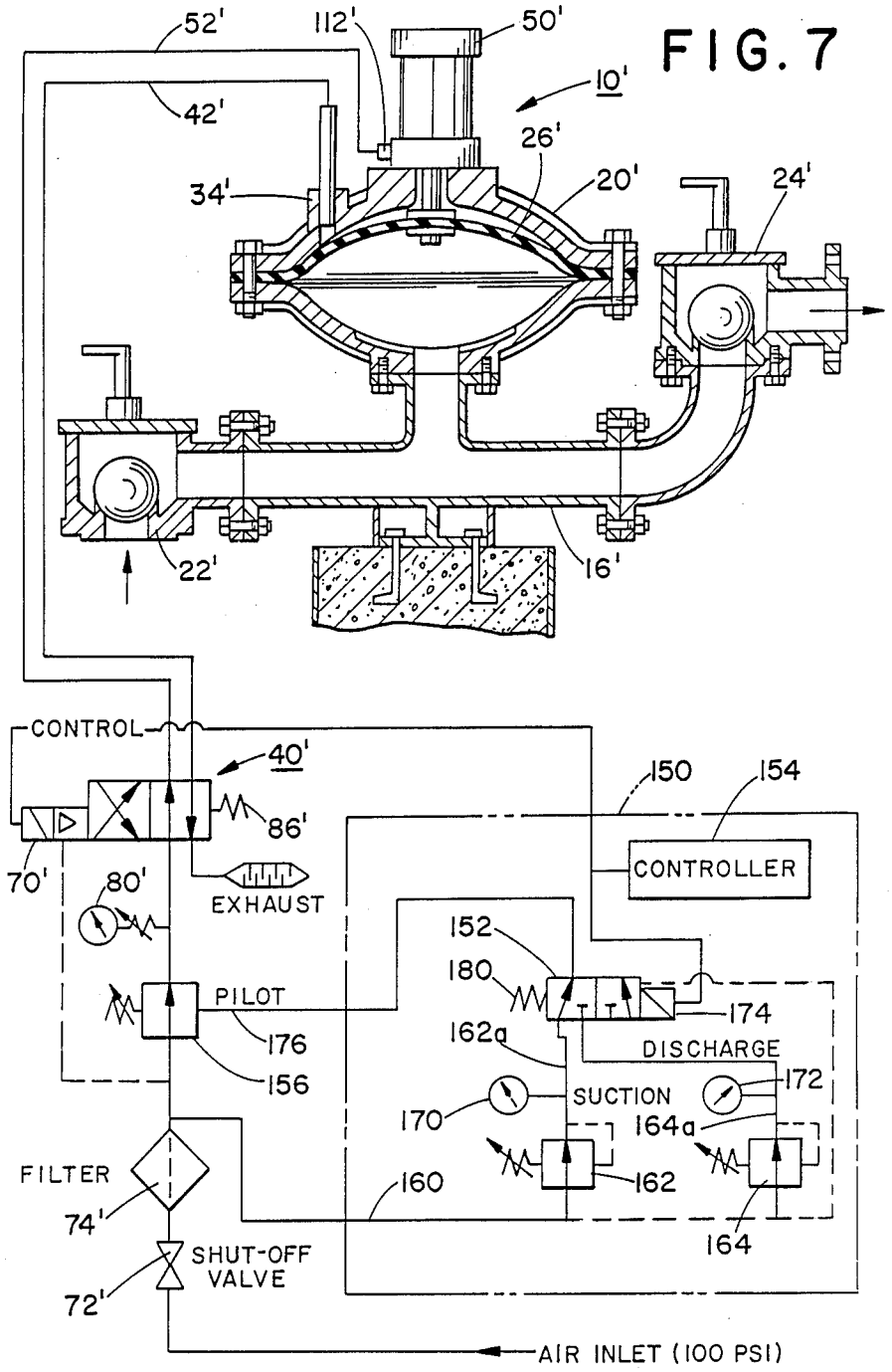
FIG. 7 is a hydraulic schematic of a second embodiment of a diaphragm pump where the pressure applied to the assist cylinder on the suction stroke is different from the pressure applied to the diaphragm on the discharge stroke.

Turning now to FIG. 7, the diaphragm pump 10' is shown to have a return assist cylinder 50' having an air inlet 112' coupled to a reversing valve 40' via a conduit 52'. The diaphragm 26' is pressurized on the pump discharge stroke by routing air under pressure into the housing 20' through a pump housing air inlet 34'. On the pump's discharge stroke, the air is routed through the four way valve 40' through a conduit 42' connected to the housing inlet 34'.

A pressure regulator 150 adjusts the pressure of the air delivered through the valve 40' so that pressure applied to the cylinder 50' on the pump's suction stroke is less than pressure applied to the diaphragm on the discharge stroke. In accordance with one typical pumping operation the pressure applied to the diaphragm on the discharge stroke is about 45 psi and the pressure routed to the cylinder 50' on the return stroke is about 5 psi.

In the FIG. 7 embodiment the regulator 150 includes a control timer 154 that actuates both the valve 40' and a 3 way solenoid valve 152 that controls pressure routed to the valve 40' by a pressure regulator 156. High pressure air (100 psi.) is routed through a shutoff valve 72' and filter 74' to the regulator 156. At a regulator input 160 air enters the regulator 150 and is coupled to two user adjustable pressure regulators 162, 164 having outputs **162*a*, 164*a* connected to the 3 way valve 152. Air at the output 162*a* from the regulator 162 can be reduced, for example, to a pressure of about 5 psi. This pressure is operator-adjustable and can be monitored on a visual indicator 170. Air at the output 164*a* of the regulator 164 can be adjusted to a pressure of about 45 psi and is also operator-adjustable. A second visual indicator 172 allows the operator to accurately adjust the pressure in the output 164*a***. The disclosed valves of suction and discharge pressures are illustrative and can be changed depending on the pumping application.

The timer 154 synchronizes actuation of the two valves 40', 152. The same control signals from the timer 154 are coupled to a solenoid 70' and solenoid 174 that actuate the valves 40', 152. The solenoid 70' moves the valve spool against the restoring force of a spring 86' when it is energized and the solenoid 174 works against the restoring force of a spring 180. When air is routed through the valve 40'0 to the cylinder 50' (FIG. 7) the solenoids 40', 174 are de-energized and 5 psi air is coupled to a pilot input 176 of the regulator 156 causing 5 psi air to be routed through the valve 40'.

When the controller 154 activates the solenoids 70', 174 to shift pressurized air to the pump diaphragm 26' it routes 45 psi air to the pilot input 176 of the regulator 156. Thus, the discharge air pressure against the diaphragm 26' is about 45 psi and the suction air pressure delivered to the cylinder 50' about 5 psi. This can be confirmed by viewing the air pressure on an indicator 80'.

The timer 84 is suitable for use in controllably actuating the solenoids 70', 174. The high and low solenoid outputs must merely be multiplexed to provide two solenoid energization signals.

A preferred controller valve 152 comprises a MAC Model No. 251B 3-way solenoid valve. The regulator 156 is a NORGREN Model No. 11-042 pilot operated regulator.

The present invention has been described with a degree of particularity. It is the intent, however, that the invention include all modifications and alterations falling within the spirit or scope of the appended claims.

We claim:

1. Diaphragm pump apparatus comprising:

(a) a pump housing that defines a pumping chamber having an effluent inlet to deliver effluent to the chamber, a flexible diaphragm supported within the chamber to apply pressure to effluent entering the pumping chamber, and an effluent outlet to discharge effluent from the pumping chamber, said housing having a fluid port for routing pressurized fluid into the pumping chamber against the flexible diaphragm;

(b) return means including a pressure cylinder having a drive piston attached to the diaphragm for reversing the direction of diaphragm movement within the pumping chamber during a return stroke, said pressure cylinder having a cylinder input port to pressurize said cylinder;

(c) pressure means for directing fluid at a regulated pressure against the diaphragm to move the diaphragm during the pump discharge stroke and for directing fluid at a regulated pressure to the pressure cylinder during the return stroke;

(d) reversing valve means having a reversing valve including pressure inlet coupled to the pressure means, an exhaust outlet to atmosphere, a first valve port coupled to the fluid port of the pump housing, and a second valve port coupled to the inlet port of said pressure cylinder; said reversing valve including a movable valve actuator wherein a first actuator position routes fluid from the pressure inlet and out said first valve port to the fluid port of the pump housing and vents the pressure cylinder input port to atmosphere through the second valve port and out the exhaust outlet during the pump discharge stroke and a second actuator position routes pressurized fluid from the pressure inlet out said second valve port to the pressure cylinder input port and vents the pumping chamber to atmosphere through the first valve port and out the exhaust outlet during the return stroke; and (e) timer means including control means for adjusting a pump cycle time, said timer means coupled to said reversing valve means to switch the movable valve actuator between said first and second valve actuator positions and cycle the pump through alternate discharge and return strokes at a controlled cycle rate.

2. The diaphragm pump of claim 1 wherein the timer means includes an adjustable control for allocating an amount of time to the return stroke and to the discharge stroke in each pump cycle.

3. The diaphragm pump of claim 1 wherein the cycle time set by said timer, the discharge period set by the timer, and pressure of fluid passing through the valve means are adjustable to control pumping action and maximize effluent volume throughput.

4. The diaphragm pump of claim 1 further comprising a sensor mounted to the pump housing to monitor moisture above the diaphragm and to de-activate the timer in the event the diaphragm ruptures.

5. A diaphragm pump comprising:

(a) a pump housing that defines a pumping chamber having an effluent inlet to deliver effluent to the chamber, a flexible diaphragm supported within the chamber to apply pressure to effluent entering the pumping chamber, and an effluent outlet to discharge effluent from the pumping chamber, said housing having a fluid port for routing pressurized fluid into the pumping chamber against a flexible diaphragm;

(b) pressure means for directing fluid under pressure against the diaphragm to move the diaphragm during a pump discharge stroke;

(c) return means including a pressure cylinder having a drive piston attached to the diaphragm for reversing the direction of diaphragm movement during a return stroke, said pressure cylinder having a cylinder input port to activate said cylinder;

(d) reversing valve means having a reversing valve including pressure inlet coupled to the pressure means, an exhaust outlet to atmosphere, a first valve port coupled to the fluid port of the pump housing, and a second valve port coupled to the inlet port of said pressure cylinder; said reversing valve including a movable valve actuator wherein a first actuator position routes fluid from the pressure inlet and out said first valve port to the fluid port of the pump housing and vents the pressure cylinder input port to atmosphere through the second valve port and out the exhaust outlet during the pump discharge stroke and a second actuator position routes pressurized fluid from the pressure inlet out said second valve port to the pressure cylinder input port and vents the pumping chamber to atmosphere through the first valve port and out the exhaust outlet during the return stroke;

(e) pressure regulator means for adjusting pressure routed to the reversing valve means pressure inlet by the pressure means and vary said pressure between a discharge stroke pressure and a return stroke pressure less than the discharge stroke pressure;

(f) timer means including control means for adjusting a pump cycle time, said timer means having one control output coupled to said reversing valve means to switch the movable valve actuator between said first and second valve actuator positions and cycle the pump through alternate discharge and return strokes at a controlled cycle rate, said timer means having a second control output coupled to the pressure regulator to route discharge pressure through the reversing valve to the diaphragm and to route return stroke pressure through the reversing valve to the pressure cylinder.

6. The diaphragm pump of claim 5 wherein the timer means includes an adjustable control for allocating an amount of time to the return stroke and to the discharge stroke in each pump cycle.

7. The diaphragm pump of claim 5 wherein the cycle time set by said timer, the discharge period set by the timer, and both discharge pressure and return stroke pressure of fluid passing through the valve means are adjustable to control pumping action and maximize effluent volume throughput.

8. The diaphragm pump of claim 5 further comprising a sensor mounted to the pump housing to monitor moisture above the diaphragm and to de-activate the timer in the event the diaphragm ruptures.

* * * * *